US010150938B2

(12) United States Patent
Roy et al.

(10) Patent No.: US 10,150,938 B2
(45) Date of Patent: Dec. 11, 2018

(54) TRANSLUCENT OR TRANSPARENT, SELF-STANDING, AUTOMATIC DISHWASHING GEL

(71) Applicant: Reckitt Benckiser (Brands) Limited, Slough (GB)

(72) Inventors: Pavlinka Roy, Heidelberg (DE); Claudia Schmaelzle, Heidelberg (DE)

(73) Assignee: RECKITT BENCKISER (BRANDS) LIMITED, Slough (GB)

( * ) Notice: Subject to any disclaimer, the term of this patent is extended or adjusted under 35 U.S.C. 154(b) by 0 days.

(21) Appl. No.: 15/500,513

(22) PCT Filed: Aug. 6, 2015

(86) PCT No.: PCT/GB2015/052280
§ 371 (c)(1),
(2) Date: Jan. 30, 2017

(87) PCT Pub. No.: WO2016/024093
PCT Pub. Date: Feb. 18, 2016

(65) Prior Publication Data

US 2017/0218314 A1 Aug. 3, 2017

(30) Foreign Application Priority Data

Aug. 11, 2014 (GB) ..... 1414179.0
Oct. 9, 2014 (GB) ..... 1417895.8

(51) Int. Cl.

| | |
|---|---|
| ***C11D 17/00*** | (2006.01) |
| ***C11D 3/43*** | (2006.01) |
| ***C11D 10/04*** | (2006.01) |
| ***C11D 17/04*** | (2006.01) |
| ***C11D 1/66*** | (2006.01) |
| ***C11D 3/20*** | (2006.01) |
| ***C11D 3/37*** | (2006.01) |
| ***C11D 17/06*** | (2006.01) |
| *C11D 1/72* | (2006.01) |
| *C11D 1/722* | (2006.01) |

(52) U.S. Cl.
CPC ..... *C11D 17/003* (2013.01); *C11D 1/66* (2013.01); *C11D 3/2065* (2013.01); *C11D 3/2068* (2013.01); *C11D 3/2075* (2013.01); *C11D 3/3723* (2013.01); *C11D 3/43* (2013.01); *C11D 10/045* (2013.01); *C11D 17/0052* (2013.01); *C11D 17/0095* (2013.01); *C11D 17/042* (2013.01); *C11D 17/06* (2013.01); *C11D 1/72* (2013.01); *C11D 1/722* (2013.01)

(58) Field of Classification Search
CPC ..... C11D 17/003; C11D 3/43; C11D 10/045
See application file for complete search history.

(56) References Cited

U.S. PATENT DOCUMENTS

| | | | | |
|---|---|---|---|---|
| 4,206,069 A | 6/1980 | Borrello | | |
| 4,929,380 A | 5/1990 | Schulz et al. | | |
| 4,992,107 A * | 2/1991 | Itoku | C11D 1/523 | 134/26 |
| 5,538,662 A * | 7/1996 | Klier | C11D 3/43 | 510/284 |
| 5,880,083 A * | 3/1999 | Beaujean | C11D 3/3947 | 252/186.43 |
| 6,534,462 B1 * | 3/2003 | Hamilton | C11D 3/2044 | 510/283 |
| RE38,262 E * | 10/2003 | Rolando | C11D 1/008 | 134/25.2 |
| 2004/0142846 A1 * | 7/2004 | Hines | C11D 3/2013 | 510/421 |
| 2007/0270325 A1 * | 11/2007 | de Buzzaccarini | B65D 47/2018 | 510/424 |
| 2011/0152154 A1 * | 6/2011 | Loeffler | C11D 1/835 | 510/218 |
| 2012/0108487 A1 * | 5/2012 | Graham | C11D 17/042 | 510/221 |
| 2013/0065812 A1 * | 3/2013 | Kohnke | C11D 3/2044 | 510/437 |
| 2014/0179584 A1 * | 6/2014 | Catlin | B65B 9/04 | 510/220 |
| 2015/0157540 A1 * | 6/2015 | Rizk | A61K 8/042 | 510/122 |

FOREIGN PATENT DOCUMENTS

| | | | |
|---|---|---|---|
| DE | 2132035 | * | 1/1973 |
| DE | 2132035 A1 | | 1/1973 |
| WO | 94/25557 A1 | | 11/1994 |
| WO | 2012/027404 A1 | | 3/2012 |

OTHER PUBLICATIONS

International Search Report and Written Opinion of the International Searching Authority for International Patent Application No. PCT/GB2015/052280 dated Oct. 23, 2015.
Combined Search and Examination Report for United Kingdom Patent Application No. GB1414179.0 dated Feb. 27, 2015.

* cited by examiner

*Primary Examiner* — Charles I Boyer
(74) *Attorney, Agent, or Firm* — Troutman Sanders LLP; Ryan Schneider; Chris Davis

(57) ABSTRACT

The present invention provides a transparent or translucent, self-standing, automatic dishwashing gel, comprising a water-soluble $C_{14}$-$C_{22}$ fatty acid salt, at least 50 wt % liquid non-ionic surfactant, less than 15 wt % water, and optionally a polar organic solvent.

20 Claims, No Drawings

TRANSLUCENT OR TRANSPARENT, SELF-STANDING, AUTOMATIC DISHWASHING GEL

TECHNICAL FIELD

The present invention is in the field of automatic dishwashing detergents. In particular, it relates to a transparent or translucent automatic dishwashing detergent gel that is self-standing, contains a high proportion of non-ionic surfactant, and is suitable to be held in a water-soluble or water-dispersible container.

BACKGROUND

So-called "monodose" detergent products are convenient for consumers, since there is no need to measure out the required volume of detergent each time. Various monodose formats, including tablets, and containers made of water soluble material, are already known. Water-soluble containers are attractive since they avoid direct consumer contact with the detergent contents which are potentially irritant, can have a faster dissolution profile than tablets (because the detergent contents do not need to be compacted particles), and can enclose a wide range of different types of detergent ingredients including solids, liquids and gels. With multi-compartment containers, more than one type of composition can be incorporated (e.g. one solid and one liquid composition), incompatible ingredients can be kept separate until use, compartments can be designed to release their respective contents at different times in the wash, and/or greater opportunities for improved aesthetics are provided.

Anionic surfactants are a major component of soaps. However, automatic dishwashing processes are sensitive to the inclusion of foaming ingredients, like anionic surfactants, because the spray action of dishwashing machines is capable of creating a lot of foam which can overflow the machine. Therefore, the skilled person generally tries to use a low level of, or no, anionic surfactants in automatic dishwashing detergents. Instead, non-ionic surfactants are commonly included in automatic dishwashing ("ADW") compositions; they can provide a detergent and rinse aid function. A wide range of different surfactants are available, some in the solid state at room temperature and some in the liquid state at room temperature.

In practice in the ADW field, the choice of available sizes and shapes of monodose products is limited by the size and shape of machine dispensers into which they are to be placed. There is also a general demand in the art for more concentrated products which use less packaging and/or confer better performance by including higher amounts of active ingredients. It would therefore be useful to have an ADW detergent composition containing a high level of non-ionic surfactant.

Liquid ADW compositions containing high levels of liquid non-ionic surfactant are known, as are solid ADW compositions containing relatively high levels of solid non-ionic surfactant. However, gel formats are visually very attractive to consumers, especially transparent or translucent gels. In addition, liquids and low viscosity gels are liable to leak out of a container if the container material becomes damaged, so self-standing gels would be desirable in this context. In principle, liquid non-ionic surfactants can be gelled using a suitable gellant and solvent, and liquid systems containing dissolved or dispersed solid non-ionic surfactants can also be gelled, but it is a great challenge to formulate a gel which contains a high level of the surfactant, which is self-standing and which is not opaque. For instance, aggregations of surfactant molecules in the gel on the macroscopic scale can scatter light. Dilution of the surfactant content in the gel might help render it more transparent, but would be counter to one of the other technical aims of the formulator.

A further factor is that, when dealing with containers made from water soluble material, it is important to ensure that this material does not dissolve or deteriorate prior to the intended usage point of the container. Adverse interactions between the container material and the container contents during storage can potentially lead to container deformation, loss of mechanical strength of the product and it being rendered unattractive. For this reason it is helpful for the detergent formulation inside the container to have a low water content, or at least a low free water content, otherwise the containers may be liable to soften or crack over time. When space is an issue, it is also important to minimise the levels of carriers not contributing to performance in the wash, such as water.

WO2012/027404 discloses an automatic dishwashing product in which a polyvinylalcohol pouch encloses a "solid gel" formulation of high viscosity at room temperature, which is said to be layered directly on top of a powder detergent formulation. The solid gel formulation contains 76% dipropylene glycol, 19% water and 5% sodium stearate. The stearate is said to be added to create structure. The opacity or otherwise of the gel is not discussed. This gel does not contain any non-ionic surfactant, and so the detergency performance of the gel is thereby significantly impaired. In addition, the high water and dipropylene glycol content is disadvantageous for pouch stability. Although lower water levels and the optional inclusion of non-ionic surfactant are mentioned, this document suggests that the inclusion of at least 70% dipropylene glycol is essential. Accordingly, high levels of surfactant could not be included within the scope of this teaching. In addition, there is no mention of whether or not the non-ionic surfactant that is optionally included in the gel is a liquid compound; if high levels of solid surfactant were to be dispersed in the gel, the resulting composition may well be opaque.

WO94/25557 refers to the inclusion of metal salts of stearate in liquid/gel automatic dishwashing detergents as a rheological modifier/thickener, in an amount of up to 2%, but these ingredients seem to be less preferred in this document due to additional processing requirements thought to be needed. There is no discussion of the opacity or otherwise of the composition; also, the surfactant content is relatively low and the water content is high.

There is still a need in the art for a transparent/translucent, self-standing, low water content ADW gel containing high levels of non-ionic surfactant. Such a gel would be advantageous even when not incorporated in a water soluble container.

SUMMARY OF THE INVENTION

In a first aspect of the invention there is provided a transparent or translucent, self-standing, automatic dishwashing gel containing a water-soluble salt of a $C_{14}$-$C_{22}$ fatty acid, at least 50 wt % liquid non-ionic surfactant, less than 15 wt % water, and optionally a polar organic solvent.

In a second aspect of the invention there is provided a water-soluble container, having a gel according to the invention in its first aspect situated inside the container.

In a third aspect of the invention there is provided a product comprising a gel according to the invention in its first aspect in direct contact with a second composition.

In a fourth aspect of the invention there is provided a method of making a gel according to the invention in its first aspect, comprising combining the fatty acid salt, at least some of the non-ionic surfactant, and at least some of the water and/or organic solvent, if present, with stirring at 10-40° C., heating the mixture to 50-80° C. to form a transparent or translucent fluid, and cooling to form the gel.

In a fifth aspect of the invention there is provided an automatic dishwashing process using the gel according to the invention in its first aspect, the container according to the invention in its second aspect or the product according to the invention in its third aspect.

In a fifth aspect of the invention there is provided the use of the gel according to the invention in its first aspect, the container according to the invention in its second aspect or the product according to the invention in its third aspect for automatic dishwashing.

DETAILED DESCRIPTION

All percentages mentioned herein are % by weight unless otherwise stated or the context otherwise requires.

Gel Properties

The gel of the invention is self-standing, and does not flow at 20° C., 1 atm pressure. Accordingly, it is too viscous for reliable viscosity measurements to be made at 20° C. using a device such as a Brookfield viscosimeter.

In an embodiment, the gel is thermoreversible.

In an embodiment, the gel starts to melt/flow on heating at a temperature of 40° C. or higher, preferably 45° C. or higher, preferably 50° C. or higher. Complete melting/transition to a flowable liquid may occur over a temperature range, and is preferably complete by 85° C. or less, preferably 80° C. or less, preferably 75° C. or less.

Desirably, the gel has a high solubility in warm water. The solubility can be quantified according to the following method:

A 11 glass beaker is filled with 800 ml water which is at 45° C. and has a hardness of 18° gH. The beaker is equipped with a magnetic stirrer bar rotating at 250 revolutions per minute. A 2 g cube of gel is placed inside a tea strainer of the spherical clam-shell type (diameter of mesh ball 4.5 cm, with 0.7 mm holes in the mesh) and immersed in the water above the stirrer bar. The time it takes for the gel to be fully dissolved (by visual inspection, no gel left inside the tea strainer) is measured.

In an embodiment, the dissolution time of the gel according to this method is 20 minutes or less, preferably 19, 18, 17, 16, 15, 14, 13, 12, 11 or 10 minutes or less.

Advantageously, the gel does not need to melt in order to dissipate in the wash; it retains its gel structure even when exposed to high temperatures during storage, but dissolves at a lower temperature so that it becomes active quickly in the wash.

The gel of the invention is transparent or translucent. The concepts of transparency and translucency are easily understood by the skilled person, but quantification is not so straightforward in view of the fact that the gels of the present invention may be coloured or colourless. Visible light does not pass through an opaque material, and so the light transmission level $T_L$ (amount of transmitted light as a percentage of incident light) compared to distilled water (designated as having a $T_L$ of 100%) can in some cases be a useful descriptor. However, such measurements are typically taken at a particular wavelength of light, and so differently coloured materials with the same degree of transparency can give rise to different $T_L$ measurements. For example, a transparent blue/green gel would show a different $T_L$ at 500 nm from a similarly transparent red gel or colourless gel.

In an embodiment, the gel is colourless and a 2 mm thick piece of the gel has a light transmission level $T_L$ at 500 nm of at least 70% compared to distilled water, preferably at least 75%, at least 80%, at least 85%, or at least 90%.

In an embodiment, the gel is coloured due to the inclusion of a dye or other colourant, however in the absence of the colourant a 2 mm thick piece of it would have a light transmission level $T_L$ at 500 nm of at least 70% compared to distilled water, preferably at least 75%, at least 80%, at least 85%, or at least 90%.

In an embodiment, when the gel is melted to remove air bubbles and filled into a 10 ml glass beaker to a depth of 2.5 cm and allowed to cool and solidify, then placed over a white piece of paper printed with black text in Times New Roman font size 10, the text can be read through the gel.

Fatty Acid Salt

In the first aspect of the invention, the fatty acid salt acts as a gelling agent.

The fatty acid salt may be any suitable water-soluble salt of the corresponding fatty acid, but is preferably an unsaturated $C_{14}$-$C_{22}$ fatty acid salt or a mixture thereof. In an embodiment, it is a $C_{16}$-$C_{20}$ fatty acid salt, preferably a $C_{16}$-$C_{18}$ fatty acid salt, preferably a mixture of a $C_{16}$ fatty acid salt and a $C_{18}$ fatty acid salt. In an embodiment, the fatty acid salt comprises a stearate. In an embodiment, the fatty acid salt comprises a mixture of a palmitate and a stearate.

In an embodiment, the fatty acid salt is in the form of an alkali metal salt, for example a lithium, sodium or potassium salt, or a mixture thereof. Preferably it is a sodium salt. Preferably it comprises sodium stearate. Preferably, it is a mixture of sodium stearate and sodium palmitate. The amount of the fatty acid salt(s) in the gel should preferably be selected so as to have the desired gelling effect whilst minimising the level of foaming, and creation of insoluble deposits of the corresponding calcium salt in the wash. In an embodiment, the gel contains up to 10 wt % of the fatty acid salt(s), more preferably up to 9 wt %, up to 8 wt %, up to 7 wt %, up to 6 wt %, up to 5 wt %, up to 4 wt %, or up to 3.5 wt % of the fatty acid salt(s). Preferably, the amount of the fatty acid salt(s) is at least 0.1 wt %, at least 0.3 wt %, at least 0.5 wt %, at least 0.8 wt %, at least 1 wt %, at least 2 wt %, or at least 2.5 wt %, of the gel.

Water

In an embodiment, the gel contains less than 12 wt % water, preferably less than 10 wt %, less than 9 wt %, less than 8 wt %, less than 7 wt %, or less than 6 wt %, water, more preferably the water content is 5 wt % or less. A lower water content increases the storage stability of the gel. However, a small amount of water may be desirable, for instance if there are certain ingredients to be included which need to be (or are better) dissolved in water. In an embodiment, the gel contains at least 0.1 wt %, preferably 0.2 wt %, 0.3 wt %, 0.4 wt %, 0.5 wt %, 1.0 wt %, 1.5 wt %, 2.0 wt %, or 2.5 wt % water.

Solvent

In an embodiment, the gel contains a polar organic solvent, preferably a polar protic solvent. The solvent aids in dissolution of the fatty acid salt and optionally other ingredients in the gel, especially when the water content is low. Thereby, it helps to ensure transparency or translucency of the gel. Preferably, the solvent is fully miscible with water.

When the gel is to be included in a water soluble container, the solvent may be a plasticiser for the container material. The solvent preferably also reduces brittleness of the gel.

Heating may be required during the manufacturing process to facilitate dissolution of the fatty acid salt in the gel precursor; accordingly, the solvent is preferably one with a relatively low vapour pressure, so that the gel precursor can be heated without drying out too much. In an embodiment, the solvent has a vapour pressure of less than 1 kPa at 25° C. and 1 atm pressure, preferably less than 0.1 kPa, preferably less than 0.01 kPa under these conditions.

Preferably, the solvent is a glycol or an ester of citric acid. Suitable esters of citric acid are of the formula $R^1O—C(CH_2CO_2R^2)_3$ in which $R^1$ is H or $C(O)R^3$, each $R^2$ is independently an alkyl group (preferably a $C_1$-$C_5$ alkyl group, preferably a $C_2$-$C_4$ alkyl group) and $R^3$ is an alkyl group (preferably a $C_1$-$C_5$ alkyl group, preferably a $C_2$-$C_4$ alkyl group). Examples include trialkyl citrate, such as triethyl-, tripropyl- or tributyl-citrate, and trialkyl-2-acetylcitrate, such as triethyl-, tripropyl- or tributyl-2-acetylcitrate.

Preferably however, the solvent is a glycol, preferably an alkylene glycol (such as ethylene glycol, propylene glycol or butylene glycol), or a dialkylene glycol. More preferably it is monopropylene glycol or dipropylene glycol, most preferably dipropylene glycol (DPG). DPG confers particularly good levels of transparency on the resulting gel, and is capable of plasticising, without causing any significant deformation of, a water soluble container into which the gel is placed.

In an embodiment, the gel contains up to 30 wt % polar organic solvent, preferably up to 29 wt %, up to 28 wt %, up to 27 wt %, up to 26 wt %, or up to 25 wt % polar organic solvent. Preferably, the amount of polar organic solvent in the gel is at least 1 wt %, at least 2 wt %, at least 3 wt %, at least 4 wt %, or at least 5 wt %.

Surfactant

The inventive gel comprises a liquid non-ionic surfactant. The surfactant desirably affords cleaning and rinse aid performance. By virtue of it being a liquid, it can act as the main component of the formulation to be gelled and be present in high amounts. It would not be possible to include solid surfactants in a gel in high amounts and retain transparency. The non-ionic surfactant is a "liquid" one in the sense that this is an ingredient that is in the liquid state at room temperature (preferably at 20° C.) prior to incorporation into the gel; clearly, once the gel has been formulated, this surfactant may be considered to be in a gelled state inside the gel, rather than in a liquid state.

In an embodiment, the gel comprises at least 55 wt %, preferably at least 60 wt %, preferably at least 65 wt %, preferably at least 68 wt %, preferably at least 70 wt % liquid non-ionic surfactant. A mixture of liquid non-ionic surfactants may optionally be used, in which case these percentages refer to their total content in the gel.

Preferably, the liquid non-ionic surfactant is low-foaming. Preferably, it has a cloud point (measured at 1% in water) below 60° C., preferably below 55° C., preferably below 50° C., preferably below 45° C. In an embodiment, it has a cloud point (measured at 1% in water) above 20° C., above 25° C., above 30° C., or above 35° C.

Suitable liquid non-ionic surfactants include liquid alcohol alkoxylates, preferably alcohol ethoxylates or alcohol propoxylate ethoxylates, preferably ethoxylated fatty alcohols or fatty alcohol propoxylate ethoxylates. The surfactants are optionally end-capped. In an embodiment, the optional end cap is a hydroxylated alkyl group, preferably a $CH_2CH(OH)R$ group in which R is alkyl.

In a preferred embodiment, the liquid non-ionic surfactant is of the formula $R^1O\text{-}(EO)_x—(PO)_y—R^2$ in which: EO and PO stand for ethoxylate and propoxylate groups respectively, but the order of EO and PO groups may be varied; x and y are independently 0-20, provided that the sum of x and y is at least 3; $R^1$ is an alkyl or alkenyl group; and $R^2$ is H or an optionally substituted (preferably optionally hydroxylated) alkyl or alkenyl group. It will be appreciated that the surfactant may comprise a mixture of compounds such that x and y represent statistical average values and $R^1$ and $R^2$ may each independently have a range of carbon chain lengths. The surfactant may be a random or block copolymer.

Preferably, one or more of the following criteria apply:

- $R^1$ is a saturated group;
- is a $C_8$-$C_{22}$ group, preferably a $C_9$-$C_{20}$ group, preferably a $C_{10}$-$C_{17}$ group, preferably a $C_{11}$-$C_{16}$ group, preferably a $C_{12}$-$C_{15}$ group;
- $R^2$ is H or an optionally hydroxylated alkyl group, preferably H or a $C_1$-$C_6$ alkyl group;
- x and y are independently 0-15, preferably at least 1, at least 2, or at least 3, preferably up to 14, up to 13, or up to 12;
- the sum of x and y is at least 4, preferably at least 5, 6, 7, 8, 9 or 10, and preferably no more than 20, 19, 18, 17, 16. 15, 14, 13 or 12;
- y is zero and x is 3-10;
- both x and y are non-zero, preferably x and y are independently 3-9, or 4-8;
- x is greater than or equal to, preferably greater than, y, preferably x is 8 and y is 4. In a particularly suitable surfactant, x is 8, y is 4, and $R^1$ is a $C_{12}/C_{15}$ group.

Suitable surfactants can be found, for example, in the Lutensol™ and Plurafac™ ranges from BASF, the Tergitol™ range from Dow, and the Genapol™ range from Clariant, such as Genapol™ EP 2584.

In an embodiment, the total content of any solid non-ionic surfactants in the gel is no more than 10 wt %, preferably no more than 7 wt %, preferably no more than 5 wt %, preferably no more than 3 wt %, preferably no more than 1 wt %. Most preferably, the gel contains no solid non-ionic surfactant. By "solid non-ionic surfactant" is meant a non-ionic surfactant that, as a raw ingredient before incorporation in the gel, is in the solid state at room temperature (preferably at 20° C.).

In an embodiment, the total content of any anionic surfactants in the gel (not counting the fatty acid salt) is no more than 10 wt %, preferably no more than 7 wt %, preferably no more than 5 wt %, preferably no more than 3 wt %, preferably no more than 1 wt %. Most preferably, the gel contains no anionic surfactant (save for any fatty acid salt).

Polyol

In an embodiment, the gel contains an ingredient which helps maintain the transparency of the gel over storage, by acting as an inhibitor of crystallisation/precipitation of the fatty acid salt. Preferably, this ingredient is a polyol, preferably a diol or triol. Suitable diols include 2-methyl-1,3-propanediol. Preferably, however, the polyol is a triol, preferably trimethylolpropane or glycerol, preferably trimethylolpropane. In an embodiment, the polyol is a solid. In an embodiment, the gel contains up to 10 wt % of the polyol crystallisation/precipitation inhibitor, preferably up to 7 wt %, 6 wt %, 5 wt %, 4 wt %, or 3 wt %. Preferably, the gel contains at least 0.1 wt % of this ingredient, preferably at least 0.5 wt %, or 1 wt %.

Monosaccharide

In an embodiment, the gel contains a monosaccharide, preferably of the formula $C_xH_{2x}O_x$, preferably where x is 5-7, preferably a hexose, preferably glucose. The monosaccharide helps to ensure adherence of the gel to the walls of a water-soluble container into which the gel is placed; without wishing to be limited by theory, this may be due to hydrogen-bonding between the monosaccharide and the container surface. The amount of this ingredient may be at least 0.1 wt %, 0.3 wt %, 0.5 wt %, or 0.7 wt %. In an embodiment, it is up to 5 wt %, 4 wt %, 3 wt % or 2 wt %.

Other Ingredients

Other ingredients may be included in the gel provided that they do not prevent it from being transparent/translucent and a self-standing gel. For example, if high amounts of solid components (such as builder that is insoluble in the surfactant) were to be incorporated, the suspended solid particles would scatter light and render the composition opaque, and also convert it to more of a paste-like form. However, small amounts of liquid ingredients, e.g. liquid enzymes, dyes and fragrances, can generally be included without problems. It may also be possible to include solid ingredients provided that their concentration is low enough. In an embodiment, the total amount of any builders in the gel is no more than 10 wt %, preferably no more than 7 wt %, preferably no more than 5 wt %, preferably no more than 3 wt %, preferably no more than 1 wt %. More preferably, the gel does not contain any builder and/or bleach.

In an embodiment, the gel does not contain any other active ingredients.

Container

The second aspect of the invention relates to a container, made from a water-soluble material, enclosing the inventive gel. It may be a single compartment or a multi-compartment container. In an embodiment, the container is a multi-compartment container.

Known processes for manufacturing containers from water-soluble materials include thermoforming, vacuum-forming, vertical form-fill-sealing, horizontal form-fill-sealing, and injection moulding. In an embodiment, the container is made by injection moulding. In an embodiment, the container is a pouch.

The container material(s) used in the invention are water-soluble, which term is intended to include water dispersible. The walls of the container may be made from the same or different container materials. If they are made of the same material, they may be of different thicknesses. If they are made of different materials, they may be of different thicknesses and/or the materials may have a different inherent solubility. The materials typically comprise a water-soluble polymer and optionally one or more additives as is known in the art, e.g. plasticiser, filler and so on.

Suitable polymers are polyvinyl alcohols, polyvinyl acetates, cellulose, cellulose ethers, and polysaccharides such as starch and gelatine. Preferred are polyvinyl alcohols, polyvinyl alcohol copolymers and hydroxylpropyl methyl cellulose, and combinations thereof. Most preferably the container material(s) comprise PVOH or a PVOH copolymer. Partially hydrolysed PVOH, as is known in the art, is particularly suitable. The container material(s) may comprise a blend of polymers, e.g. a blend of PVOH polymers of different grades.

Number of Compartments

In an embodiment, the container comprises at least 2 compartments. A higher number of compartments may require a greater total surface area of container material, given that the overall size of the container is limited. This should be balanced against the advantages of being able to provide a large number of different compositions in the container. In an embodiment, the container has 2 or 3 compartments.

Container Shape and Size

The container may have any suitable shape overall. To make most efficient use of the available space in the dispenser compartment, the container preferably has a cuboidal shape, e.g. a cube or a rectangular cuboidal shape, preferably a rectangular cuboidal shape. It will be understood in the context of the invention that these terms do not imply mathematical precision; slight bulges of the faces and rounding of the edges may be expected, consistent with the flexible nature of the container material(s) and pressure exerted by the contents.

Suitably the total volume of the compartments in the container is 40 ml or less, preferably 35 ml or less, 30 ml or less, 25 ml or less, or 20 ml or less. Suitably the longest dimension of the container is in the range of 2 to 6 cm, preferably 2.5 to 5 cm, preferably 3 to 4 cm.

Compartment Contents

Each compartment of the multi-compartment container may independently comprise any suitable form of composition, including solid, liquid, gel, paste, provided that at least one compartment contains the transparent/translucent gel of the invention. In an embodiment, at least one other compartment contains a solid composition, preferably a particulate solid composition, especially a powder. Thus, desirable solid components of the overall detergent to be supplied (such as solid builder, bleach, enzymes, etc.) can be included in the container in high amounts, without the formulation problems of trying to include them in the gel of the invention.

In another embodiment, the container has at least three compartments, one containing the transparent/translucent gel of the invention, one containing an opaque gel, and one containing a solid, especially powder, composition. Thereby both solid and liquid ingredients can be utilised which might otherwise suffer from difficulties in formulating them in the inventive gel.

In an embodiment, the gel of the invention makes up at least 10 wt % of the container contents (i.e. weight of the product excluding the container material itself), preferably at least 15 wt %, preferably at least 20 wt %. In an embodiment, the container contents comprise up to 50 wt %, preferably up to 45 wt %, up to 40 wt %, up to 35 wt % or up to 30 wt % of the inventive gel.

Multi-Phase Products

In the third aspect of the invention, the gel of the invention and a further composition, preferably a solid composition, preferably a particulate solid composition, preferably a powder or compressed powder composition, are situated in direct contact with each other. The gel of the invention is self-standing and there is substantially no intermixing of the two compositions.

In an embodiment, a compressed powder tablet is provided which is in direct contact with the gel of the invention. For example, the tablet may have a cavity that is filled or partially filled with the gel of the invention. In an embodiment, the gel of the invention and the further composition are provided within the same compartment of a container, preferably a multi-compartment container. Preferably the gel of the invention and a powder composition each form a layer within a single compartment of the container, preferably the gel is a base layer and the powder composition rests on top of the gel. In another embodiment, the gel of the invention and the further composition (preferably a powder) are provided in direct contact (preferably in layers) in a single-compartment container.

In an embodiment, the gel of the invention comprises polyethylene imine (PEI). Preferably, it comprises 0.0001-10 wt % PEI, preferably 0.0005-8 wt %, 0.001-5 wt %, 0.005-2 wt %, 0.01-1 wt %, 0.03-0.5 wt %, 0.05-0.3 wt %, 0.07-0.2 wt %, or 0.09-1.5 wt % PEI. The melting point of the gel tends to increase with increasing PEI concentration, so an appropriate balance should be struck between achieving the desired benefits of the PEI without significant adverse impacts on the manufacturing of the gel.

Preferably the polyethylene imine is a liquid at 20° C. Preferably, it has a weight average molecular weight of less than 10,000 daltons, preferably less than 6000, less than 3000, less than 1500, less than 1200 or less than 1000 daltons. Preferably, it has a weight average molecular weight of at least 100 daltons, preferably at least 200, at least 400, or at least 600 daltons.

The polyethylene imine may be branched or linear, but in a preferred embodiment it has a branched structure.

Suitable PEIs include the Lupasol™ range from BASF, particularly preferably Lupasol™ FG, which has a branched structure and a molecular weight of 800. Similar PEIs can also be obtained from Sigma-Aldrich™.

The present inventors have surprisingly found that this ingredient helps to enhance the physical and chemical stability of the multi-phase products. For example, migration of the second composition (e.g. powder) into the gel layer is reduced and the chemical stability of the second composition is increased. Without wishing to be bound by theory, it is believed that the PEI may migrate to the surface of the gel and form a barrier to entry of the powder on the one hand, and also reduce capillary draw of solvent from the gel to the powder, which would otherwise cause lumping of the powder, trigger its degradation, and lead to collapse of the gel structure.

Advantageously the second composition can contain sensitive ingredients like bleach, bleach activator and/or enzymes. In an embodiment when the gel of the invention is in direct contact with a second composition, particularly when the gel comprises PEI, the gel does not comprise a monosaccharide. In an embodiment when the gel of the invention is in direct contact with a second composition, particularly when the gel comprises PEI, the gel does not comprise glucose. The stability of such multi-phase products may be improved in the absence of the monosaccharide/glucose.

It is additionally surprising that PEI can be formulated into this water-free or reduced water gel, without adversely affecting the transparency/translucency of the gel, and whilst retaining the glass corrosion properties of the PEI.

A certain total proportion of PEI may be needed, in the overall formulation to be delivered to the wash, in order to achieve the desired additional benefit of enhanced glass corrosion inhibition. Depending on the volume of gel to be delivered, the proportion of PEI in the gel may not be sufficiently high for this (given the constraints discussed above on the amount incorporated in the inventive gel). In this case, a dose of PEI may be provided in another part of the formulation, as well as in the inventive gel. In an embodiment, the total amount of PEI in the multi-phase product (at least some of which is in the inventive gel) is at least 1 mg, at least 2 mg, or at least 3 mg, preferably up to 10 mg, up to 8 mg, or up to 5 mg. In an embodiment, both the inventive gel and a powder in direct contact with the gel contain PEI.

Manufacturing of the Gel

The gel may be made by any suitable method known to those skilled in the art. For example, the ingredients may be combined with heating to form a pourable liquid which forms a self-standing gel upon cooling. When the gel is to be included inside a water-soluble container, this conveniently allows the formulation to be filled into the container whilst in its liquid state, and gelling to a self-standing state to happen inside the container. When the gel is to be included in the same compartment as a further formulation, preferably the further formulation is only added to the compartment once the gel has taken on its self-standing state inside the compartment. For example, a formulation may be added first, forming a layer across the bottom of the compartment, and allowed to cool to form the self-standing gel, then a powder layered on top of it.

In the fourth aspect of the invention, the fatty acid salt, at least some of the non-ionic surfactant, and at least some of the water and/or organic solvent, if present, are combined with stirring in a mixing step at 10-40° C., the mixture is heated to 50-100° C. in a second step to form a transparent or translucent fluid, and this fluid is cooled to form the self-standing gel.

Preferably, the mixing step is at 12° C. or more, 15° C. or more, or 17° C. or more. Preferably, the mixing step is at 35° C. or less, 30° C. or less, or 25 35° C. or less. Preferably, in the second step the mixture is heated to at least 60° C., at least 65° C., or at least 70° C. Preferably, it is heated to 90° C. or less, 85° C. or less, or 80° C. or less.

In an embodiment, at least half of the total amount of non-ionic surfactant is used in the mixing step, preferably at least 60 wt %, 70 wt %, 80 wt % or 90 wt % of the total amount of non-ionic surfactant. Likewise, when water and/or organic solvent is used, preferably independently at least half, preferably at least 60 wt %, 70 wt %, 80 wt % or 90 wt % of the total amount of it is included in the mixing step. When less than all of the ingredients of the gel are included in the mixing step, the remainder may be added during or after the second step. For example, when a dye is used, this can be added to the heated mixture as a premix with water, organic solvent and/or non-ionic surfactant.

Desirably, the fatty acid salt is fully and evenly dispersed, without lumps, in the mixture during the mixing step, before the second step of heating is started.

The mixture at the end of the mixing step may be thixotropic. The viscosity of the transparent or translucent fluid at the end of the second step may be less than 10,000 mPa·s, preferably less than 5000 mPa·s, less than 1000 mPa·s, less than 500 mPa·s, or less than 200 mPa·s, as measured with a Brookfield viscosimeter. Upon cooling and formation of a self-standing gel, the viscosity is so high that it can no longer be measured with a Brookfield viscosimeter.

ADW Use

The fifth and sixth aspects of the invention relate to the application of the gel in automatic dishwashing. In an embodiment, the gel is comprised in a unit dose product. By "unit dose" product is meant herein that the product is intended to dissolve or disintegrate completely during a single cycle of the dishwasher. For such products, it is advantageous if the gel dissolves quickly in the wash, so that the active ingredients can start to work at an early stage. An additional benefit of using fatty acid salt as the gelling agent is that the resulting gel dissolves quickly in water, despite being self-standing. Very high viscosity gels are naturally more resistant to being broken up by the turbulent action of the water in the wash, so a high water solubility of the ingredients compensates for this.

The invention is further demonstrated by the following non limiting examples.

Examples 1-3

Gels were prepared with the following compositions, the amounts being % by weight:

| | Ex. 1 | Ex. 2 | Ex. 3 |
|---|---|---|---|
| Fatty acid salt* | 3% | 3% | 3% |
| Dipropylene Glycol | 20% | 20% | 20% |
| Nonionic Surfactant** | 68% | 72% | 68.5% |
| Trimethylolpropane | — | — | 2.5% |
| Glucose | — | — | 1% |
| Water | 9% | 5% | 5% |
| Dye | Trace | Trace | Trace |

*The fatty acid salt was a vegetable grade composition containing 38-40% sodium stearate and 59-61% sodium palmitate.
**The non-ionic surfactant was a liquid $C_{12}/C_{15}$ oxo alcohol EO-PO adduct with an average of 8 EO group and 4 PO groups per molecule.

The method used in each case was as follows. The fatty acid salt was added to the DPG and mixed to form a white homogenous slurry/paste. The surfactant was then added (with the TMP and glucose where included) and the mixture stirred. Water and dye was added while continuing to stir. The composition was then heated to 80-85° C. with continued stirring. When it became transparent, it was filled into a compartment of a multi-compartment polyvinylalcohol capsule and allowed to cool. Upon cooling, a coloured, self-standing gel was formed which was visually transparent.

In each case, the polyvinylalcohol capsule material showed no deformation after 8 weeks' storage at 40° C./75% relative humidity, and the transparency of the gel was maintained. After longer storage under these conditions, the gel of Example 3 showed better stability than that of Example 2, which in turn was better than that of Example 1.

Duplicates of the capsules of Examples 1-3 were prepared and a second compartment of each capsule was filled with a powder detergent, and a third compartment was filled with an opaque gel. Cleaning performance in an automatic dishwashing method was good for all three products, and in each case significantly better than for a corresponding capsule containing the same powder and opaque gel, but an empty first compartment.

Comparative Example 1

A gel was prepared with the following composition:

| | |
|---|---|
| Fatty acid salt (as in Example 1) | 5% |
| Dipropylene Glycol | 76% |
| Water | 19% |

A mixture of the DPG and water was heated to 73° C. The fatty acid salt was added with stirring, and when a clear solution was obtained, it was filled into a compartment of a multi-compartment polyvinylalcohol capsule of the same type as was used in Examples 1-3, and allowed to cool. Upon cooling, the gel was not transparent. The polyvinylalcohol capsule material showed heavy deformation after 8 weeks' storage at 40° C./75% relative humidity.

The second and third compartments of a fresh sample of the capsule of this comparative example was filled with the powder and opaque gel, respectively, as before. Cleaning performance in an automatic dishwashing method was similar to the corresponding capsule containing the powder and opaque gel, and an empty first compartment.

Comparative Example 2

A gel was prepared with the following composition:

| | |
|---|---|
| Fatty acid salt (as in Example 1) | 5% |
| Dipropylene Glycol | 56% |
| Nonionic Surfactant (as in Example 1) | 20% |
| Water | 19% |

A mixture of the DPG and water was heated to 73° C. The fatty acid salt and surfactant was added with stirring, and when a clear solution was obtained, it was filled into a compartment of a multi-compartment polyvinylalcohol capsule of the same type as was used in Examples 1-3, and allowed to cool. Upon cooling, the gel was partially transparent. However, after 8 weeks' storage at 40° C./75% relative humidity, the polyvinylalcohol capsule material showed heavy deformation and the gel had mostly liquified.

The second and third compartments of a fresh sample of the capsule of this comparative example was filled with the powder and opaque gel, respectively, as before. Cleaning performance in an automatic dishwashing method was still significantly worse than in Examples 1-3.

Examples 4-5: Layered Compositions

Gels were prepared with the following compositions, using the same method as in Examples 1-3, and 4 g of each was filled into a compartment of a respective polyvinylalcohol capsule:

| | Ex. 4 | Ex. 5 |
|---|---|---|
| Fatty acid salt (as in Example 1) | 3% | 3% |
| Dipropylene Glycol | 19.9% | 20% |
| Nonionic Surfactant (as in Example 1) | 71.5% | 71.5% |
| Trimethylolpropane | 2.5% | 2.5% |
| Polyethylene imine* | 0.1% | — |
| Water | 3% | 3% |
| Dye | Trace | Trace |

*the PEI had a branched structure and a molecular weight of 800.

On cooling, the gels formed were transparent and self-standing.

The following powder composition was prepared:

| | |
|---|---|
| Sodium citrate | 20% |
| Sodium carbonate | 20% |
| Co-builder (polyacrylates, phosphonates) | 42% |
| Sodium sulphate | 7% |
| TAED | 5% |
| Protease | 5% |
| Amylase | 1% |

5 g of the powder composition was filled into each capsule to form a layer directly on top of the gel.

A second compartment of each capsule was filled with 5 g of a powder comprising 60% sodium carbonate and 40% sodium percarbonate, and the capsules were sealed.

After prolonged storage at 40° C., 75% relative humidity, the compositions in the capsules containing the gel of Example 4 showed greater stability than those containing the gel of Example 5. Furthermore, glass corrosion in the wash after multiple cycles was lower using the capsules containing the gel of Example 4 than those containing the gel of Example 5.

Examples 6-7: Layered Compositions

Example 6 was a repetition of Example 4 but with the percarbonate-containing powder as the layer on the transparent gel, and the enzyme-containing powder in the second compartment. Example 7 corresponded to Example 6 except that the transparent gel of Example 5 was used instead of the transparent gel of Example 4. In the same stability and glass corrosion tests, the compositions in the capsules in Example 6 showed greater stability and afforded lower glass corrosion in the wash than for Example 7.

The invention claimed is:

1. A self-standing, automatic dishwashing gel comprising:
a water-soluble $C_{14}$-$C_{22}$ fatty acid salt;
at least 65 wt % liquid non-ionic surfactant;
less than 15 wt % water; and
a polar organic solvent,
wherein the self-standing, automatic dishwashing gel is translucent or transparent.

2. The gel as claimed in claim 1, wherein the fatty acid salt is a mixture of an alkali metal stearate salt and an alkali metal palmitate salt.

3. The gel as claimed in claim 1 comprising up to 10 wt % of the fatty acid salt.

4. The gel as claimed in claim 1 comprising less than 10 wt % water.

5. The gel as claimed in claim 1, wherein the polar organic solvent is one of a glycol or an ester of citric acid.

6. The gel as claimed in claim 1 comprising at least 70 wt % liquid non-ionic surfactant.

7. The gel as claimed in claim 1, wherein the liquid non-ionic surfactant is a liquid alcohol alkoxylate.

8. The gel as claimed in claim 1 further comprising a polyol different from the organic solvent.

9. A water-soluble container, inside which is situated a gel as claimed in claim 1, and
wherein the gel is in direct contact with a second composition.

10. A method of manufacturing the gel as claimed in claim 1 comprising:
combining the fatty acid salt, at least a portion of the non-ionic surfactant, and one or both of at least a portion of the water and the polar organic solvent, with stirring at between 10-40° C.;
heating the mixture to between 50-100° C.; and
cooling to form the gel.

11. An automatic dishwashing process comprising a step selected from the group consisting of using the gel as claimed in claim 1 and using the container as claimed in claim 9 in an automatic dishwasher.

12. The water-soluble container as claimed in claim 9, wherein the second composition is a powder; and
wherein the gel further comprises a polyethylene imine.

13. The gel as claimed in claim 1, wherein the fatty acid salt is a mixture of an alkali metal stearate salt and an alkali metal palmitate salt; and
wherein the alkali metal is selected from the group consisting of lithium, sodium, potassium and mixtures thereof.

14. The gel as claimed in claim 1 comprising between 1-5 wt % of the fatty acid salt.

15. The gel as claimed in claim 1 comprising between 1-6 wt % water.

16. The gel as claimed in claim 1, wherein the polar organic solvent is present in an amount of between 5-25 wt %.

17. The gel as claimed in claim 1, wherein the liquid non-ionic surfactant is an alcohol propoxylate ethoxylate of the formula $R^1O\text{-}(EO)_x\text{—}(PO)_y\text{—}R^2$ in which:
EO is ethoxylate;
PO is propoxylate;
the order of EO and PO groups may be varied;
x and y are independently 0-10, provided that the sum of x and y is at least 3;
$R^1$ is an alkyl or alkenyl group; and
$R^2$ is one of H and an optionally substituted alkyl or alkenyl group.

18. The gel as claimed in claim 1 further comprising one of trimethylolpropane and glycerol at between 1-5 wt %.

19. The method of manufacturing a gel as claimed in claim 10,
wherein the fluid formed by heating the mixture comprises an optical quality selected from the group consisting of transparent and translucent.

20. The gel as claimed in claim 16, wherein the polar organic solvent is dipropylene glycol.

* * * * *